United States Patent [19]

Werdelin et al.

[11] 4,026,332

[45] May 31, 1977

[54] MACHINE FOR MOUNTING METAL WIRE HANDLES ON POTS, PAILS AND SIMILAR CONTAINERS

[75] Inventors: Hans Kristian Werdelin, Nyborg; Knud Verner Hansen, Bronshoj; Jens Holst Andersen, Farum, all of Denmark

[73] Assignee: Dansk Svejsemaskine Farrik A/S, Copenhagen, Denmark

[22] Filed: May 10, 1976

[21] Appl. No.: 685,125

[30] Foreign Application Priority Data

May 9, 1975 Denmark ..... 2054/75

[52] U.S. Cl. ..... 140/93 B; 140/75

[51] Int. Cl.[2] ..... B21F 15/10

[58] Field of Search ..... 140/75, 93 B

[56] References Cited

UNITED STATES PATENTS

| | | | |
|---|---|---|---|
| 1,038,145 | 9/1912 | Inman | 140/75 |
| 3,078,882 | 2/1963 | Simon | 140/93 B |

*Primary Examiner*—Lowell A. Larson

*Attorney, Agent, or Firm*—Bacon & Thomas

[57] ABSTRACT

In a machine for mounting metal wire handles on pots, pails and similar containers, in which the handle ends are bent twice in such a way that by the second bending operation the bent-over ends provided by the first bending operation are inserted into handle fittings on the container, only a single set of bending tools are used for performing both bending operations. Preferably the two bending operations are performed by a single bending slide performing two successive bending movements in the same direction.

5 Claims, 10 Drawing Figures

MACHINE FOR MOUNTING METAL WIRE HANDLES ON POTS, PAILS AND SIMILAR CONTAINERS

Figure 1:
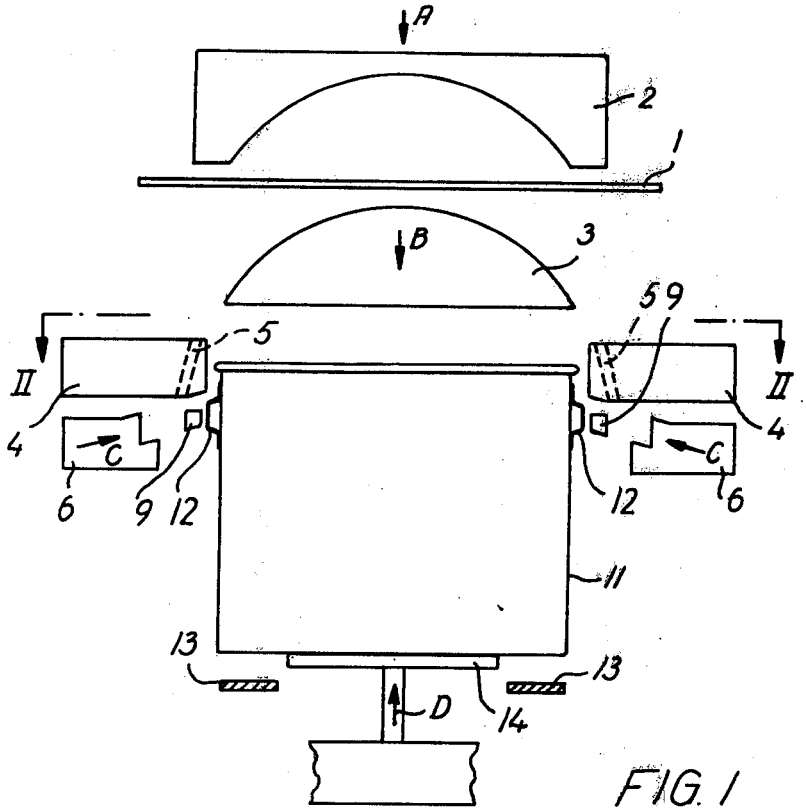

The invention relates to a machine for mounting metal wire handles on pots, pails and similar containers having handle fittings for accomodating the bent-over ends of the handles, the machine being provided with orientation means for orienting the containers in such a way that the handle fittings are aligned with the pre-bent ends of the handle and a set of bending tools for bending the handles near the bent-over ends, whereby these ends are inserted into the handle fittings.

From the French Pat. No. 2,215,279 such a machine is known where metal wire, supplied from a supply roll, is cut off into desired lengths, after which the ends of the piece of wire cut are bent over by means of separate bending tools. After the handle has been shaped in a shaping tool it is, while being still secured in the shaping tool, conveyed to a position in which the ends of the handle extend into another set of bending tools. After a container has been aligned in such a way that the handle fittings are opposite the bent-over ends of the handle, the other set of bending tools perform a bending close to the ends of the handle bent in advance, whereby these bent-over ends are inserted into the handle fittings, the container being simultaneously raised slightly on account of the last bending.

Due to the fact that the ends of the piece of wire are bent at such an early stage of the production and fitting of the handle the prior art machine must comprise means for ensuring that the bent-over ends and the rest of the handle remain in one plane during the ensuing operations. As appears from the above, the prior art machine comprises two sets of bending tools, that is to say a total of four bending tools. The result of this is that the prior art machine is of a rather complicated construction.

The object of the present invention is to remedy the drawbacks of the prior art machine, and according to the invention this is achieved by one and the same set of bending tools performing both the first bending of the handles for forming the bent-over ends of the latter and the second bending for inserting the bent-over ends into the handle fittings. Consequently, there will in this case be only one set of bending tools, that is to say two bending tools, which perform both bending operations. Since the bending operation for the formation of the bent-over ends of the handle does not take place until at a late stage, in which the shaping of the handle has already taken place and the handle is still held in the shaping tool, the risk that the bent-over ends and the handle proper will not be located in one plane is eliminated.

For the sake of good order it should be mentioned that from U.S. Pat. No. 3,241,578 a machine is known comprising only two bending tools, each of which comprises a curved duct in which the end of the handle is shaped while being advanced in the axial direction for the formation of a hook-shaped end which is inserted into the handle fitting during the shaping operation proper. This special way of forming the hook-shaped end is no actual bending and it requires a complication of the machine since very large forces are required for advancing the ends of the handle in the axial direction through the tool, the result being a heavy wear on the tool as well as the risk of an unintentional deflection of the handle during the advance.

In a particularly simple embodiment of the machine according to the invention each bending tool comprises a bending carriage or slide arranged for performing two successive operative movements in the same direction with an intermediate withdrawal. In this case in each bending tool a single movable element may be used for performing both bending operations.

A further embodiment of the machine according to the invention is characterized in that the bending slide is moved further fowards during the second operative movement than during the first movement and comprises two operation zones, one of which is arranged for interacting with a pin for performing the first bending while the other is arranged for interacting with a stationary surface in the bending tool for performing the second bending, means being provided for withdrawing the pin from the interaction with the slide during the second operative movement. In this case it is possible to let the handle proper remain immovable during both bending operations.

Instead of the said pin the machine according to the invention may be provided with means for moving the handle downwards in the time interval between the two operative movements of the bending slides. In this case, the two operative movements may be identical.

Figure 2:
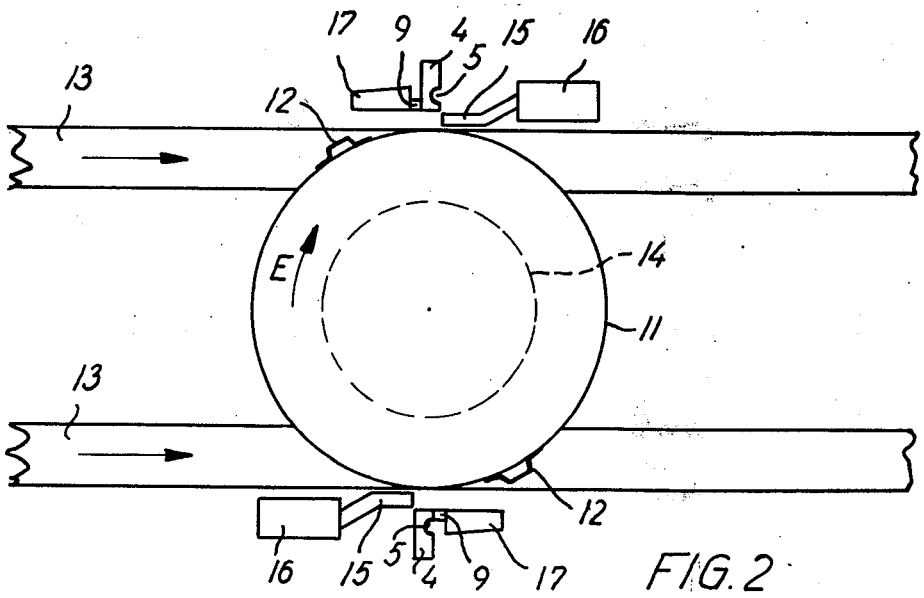
Figure 3:
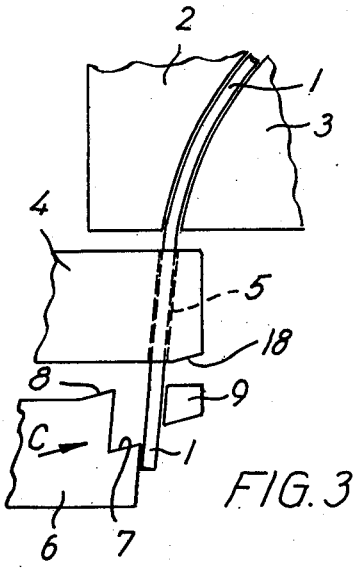
Figure 4:
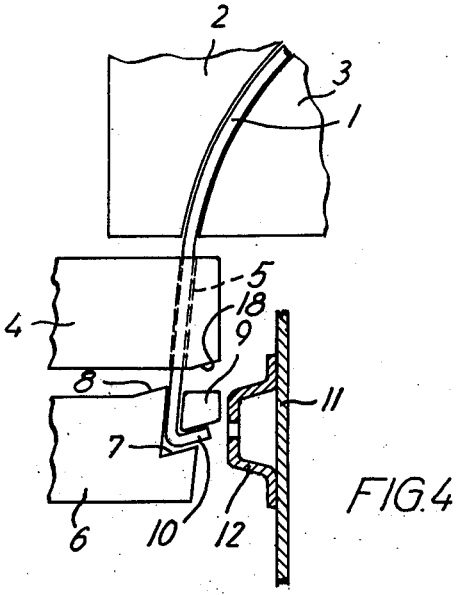

Below, the invention is explained in greater detail with reference to the schematical drawing in which FIG. 1 shows an end view of the parts of a machine according to the invention necessary for understanding the invention, FIG. 2 shows a plan view along the arrows II—II in FIG. 1 of part of the elements shown in FIG. 1, FIGS. 3–5 show, on a larger scale, a detail of the machine shown in FIGS. 1 and 2 for illustrating the bending operations and FIGS. 6–10 show some parts of another embodiment of a machine according to the invention for illustrating the bending operations in this machine.

In the machine shown in FIGS. 1–5, a piece of wire 1, from which a handle is to be produced and which is, for example, supplied from a magazine for cut-off and straightened wire pieces or is cut off directly from a supply roll, is placed in the position indicated in FIG. 1 between a matrix 2 and a patrix 3. The matrix 2 is moved downwards according to the arrow A, for example by means of a crack connection, not shown, to a main shaft in the machine, and by this means the handle is given the shape desired between the matrix 2 and the patrix 3. Subsequently, these two elements are jointly moved further downwards, *cf.* the arrow B, to the position indicated in FIG. 3 in relation to a stationary part 4 of a bending tool. By the said downward movement the end of the handle 1 is guided through a duct 5 in the part 4.

Then the first bending operation is performed by a bending slide 6 being moved in the direction indicated by an arrow C. The bending slide has two operation zones, viz. a first zone 7 and a second zone 8. In the case of the movement in the direction C the zone 7 interacts with a pin 9, whereby the extreme end of the handle is bent into the position shown in FIG. 4 which indicates the termination of the first bending operation.

Before an additional bending of the handle can be performed, the container, which is to be provided with the handle 5 and which comprises two diametrically opposed handle fittings 12, is to be placed in the correctly oriented position in relation to the bending tools. The container 11 is advanced to the bending station by means of two belt conveyors 13 and is by means, not shown, stopped exactly above a turntable 14 which can be displaced vertically as indicated by an arrow D, whereby the container 11 is raised from the conveyor belts 13. The turntable 14 rotates, for example in the direction indicated by an arrow E in FIG. 2, and carries the container 11 along with it in this rotation. Two stop members 15 are by operating mechanisms 16 brought into the path of movement of the handle fittings 12 which by abutting against the members 15 are prevented from further rotation. The displacement of the turntable 14 in the direction D determines the final level of the handle fittings, and the stop members 15 determine the final angular position of the handle fittings. After the orientation of the container, the handle fittings 12 are in the position indicated in FIG. 4 in relation to the bending tools. The orientation may be performed before or after the first bending operation. If it be desired, the upper end of the container may be guided and centered by a rotating member, not shown, which fits into the upper end of the container.

After the first bending operation and the orientation of the container have been performed, the bending slide 6 is withdrawn, either all the way back to the starting position or only a certain distance. In addition, the pin 9 is removed from the path of movement of the handling slide perferably in the direction at right angles to the plane of the drawing, e.g. by means of an operating mechanism 17, FIG. 2.

Figure 5:
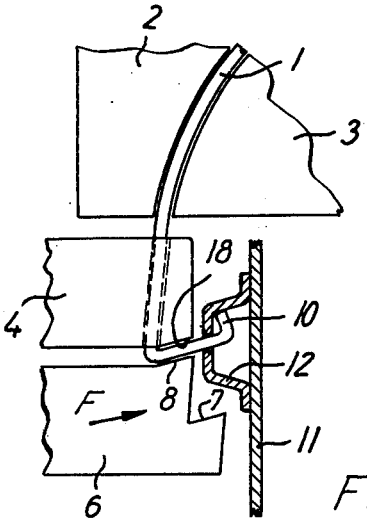

The bending slide 6 is now once more advanced in the direction of the arrow F in FIG. 5, and as now the pin 9 does not prevent its movement it may this time be advanced so much that the operation zone 8 interacting with an operation edge 18 on the stationary part 4 performs an additional bending of the handle 5 close to the bent-over end 10, whereby this bent-over end is inserted into the handle fitting 12, the container 11 being simultaneously raised.

Subsequently to the release of the handle from the matrix 2 and the patrix 3 as well as from the bending tools and after the turntable 14 has been lowered the container 11, now provided with a handle, may continue its travel on the conveyor belts 13, and a new container may be supplied to the orienting and handle fitting station.

Figure 6:
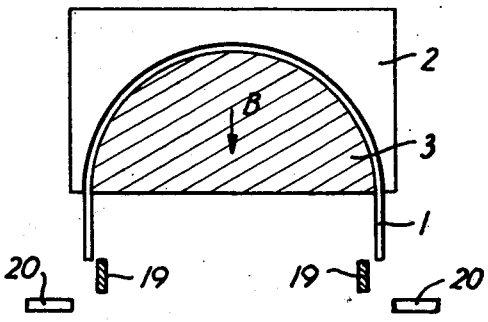

In the machine shown in FIGS. 6–10 the shaping of the handle 1 is likewise performed by means of the matrix 2 and the patrix 3 (FIG. 6). Then the patrix 3 and possibly also the matrix 2, which is not shown in FIGS. 7–10, however, are moved downwards, cf. the arrow B in FIG. 6, whereby the ends of the handle will be made to take up the positions shown in FIG. 7 relative to stationary abutments 19 and bending slides 20 in two sets of bending tools.

Figure 7:
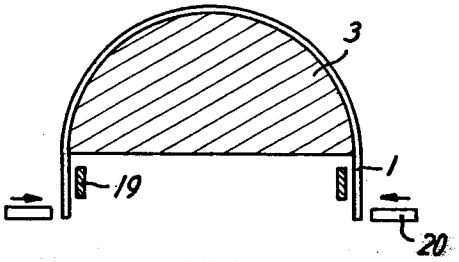
Figure 8:
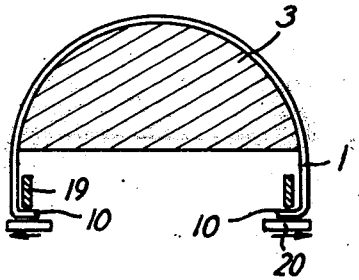

The slides 20 are then moved inwards in conformity with the arrows shown in FIG. 7, whereby the extreme ends 10 of the handle are bent over. The slides 20 are now returned, as indicated in FIG. 8, whereupon the patrix 3 is moved further downwards in conformity with the arrow G.

Figure 9:
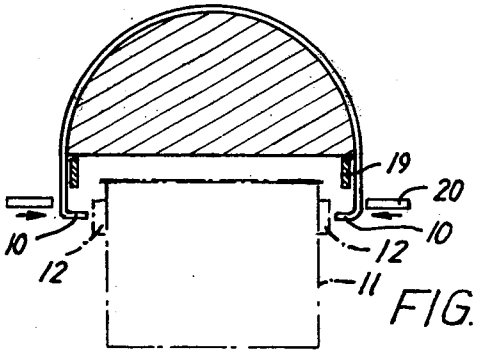

Before or after the latter operation, an orienting of a container 11, shown in FIG. 9 in dotted lines is performed so that central holes in the handle fittings 12 of the container are opposite with the bent-over ends 10.

Figure 10:
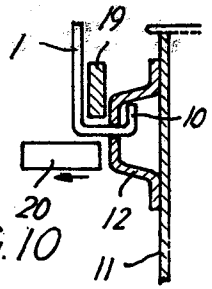

The bending slides 20 are now once more moved inwards as indicated with arrows in FIG. 9 whereby the previously bent-over ends 10 are inserted into the handle fittings 12 and the container is at the same time raised as shown in FIG. 10 which is a section on a larger scale.

After a repeated withdrawal of the bending slides 20 and the release of the handle from the patrix 3 and the abutments 19 the container, now provided with a handle, can be moved away from the orienting and handle fitting station.

An advantage of the embodiment described with reference to FIGS. 6–10 is that the movable pin, shown in FIGS. 1–4, which may give trouble when a thick wire is to be bent, can be dispensed with.

The invention is not limited to the embodiments shown in the drawing and described above, but may be modified in various ways obvious to a person skilled in the art within the scope of the following patent claims.

We claim:

1. In a machine for mounting wire handles on containers provided with handle fittings, said machine having means for positioning a container and orienting its fittings in a predetermined direction and means for forming a wire handle to generally U-shaped and positioning the ends thereof to extend downwardly adjacent said fittings, the improvement comprising:

bending tools including reciprocable members movable in one direction to bend the ends of a wire handle inwardly toward said fittings to define first bends;

said machine including further means for causing said members to engage said handles at positions spaced from said first bends and form second inward bends whereby said first bends are bent inwardly and upwardly into handle-mounting engagement with said fittings.

2. A machine as defined in claim 1 including means for retracting said members after forming said first bends and moving the same inwardly a second time to form said second bends.

3. A machine as defined in claim 3 wherein said bending tools include stationary anvils adjacent said handle and about which said first bends are formed, means for removing said anvils while said members are retracted, and said members having a first portion for engaging said handles to form said first bends and a second portion engageable with said handles to form said second bends upon a second reciprocation.

4. A machine as defined in claim 2 including means for moving said handle downwardly while said members are retracted.

5. A machine as defined in claim 4 wherein said last-named means compresses said means for forming said handle to generally U-shape.

* * * * *